United States Patent [19]

Ulicki et al.

[11] 4,339,746

[45] Jul. 13, 1982

[54] ALARM CONTROL CENTER

[75] Inventors: Edward M. Ulicki, Upper Saddle River; Gabor Schlisser, Tenafly, both of N.J.

[73] Assignee: U.S. Philips Corporation, New York, N.Y.

[21] Appl. No.: 206,928

[22] Filed: Nov. 14, 1980

[51] Int. Cl.[3] ..... G08B 19/00

[52] U.S. Cl. ..... 340/518; 340/506; 340/521; 340/537

[58] Field of Search ..... 340/506, 517, 518, 521, 340/524, 531, 533, 537, 539

[56] References Cited

U.S. PATENT DOCUMENTS 3,909,826 9/1975 Schildmeier et al. ..... 340/539

*Primary Examiner*—Alvin H. Waring

*Attorney, Agent, or Firm*—Thomas A. Briody; William J. Streeter; Edward W. Goodman

[57] ABSTRACT

An alarm control center having means for interchangeably assigning alarm parameters for each sensor loop in an array of sensor loops and for interchangeably assigning alarm outputs for each of the sensor loops. When the alarm control center senses an alarm condition on one of the sensor loops, the alarm control center increases the scanning rate for that particular sensor loop to verify the alarm condition.

8 Claims, 8 Drawing Figures

COMMUNICATIONS BLOCK DIAGRAM

ALARM CONTROL CENTER

BACKGROUND OF THE INVENTION

The invention relates to centralized monitor and control systems for monitoring the condition of alarm sensors and for controlling different alarm outputs depending on the alarm sensor condition.

In prior art multiple sensor loop systems, the sensor loop and alarm outputs had to be connected to the central system in a specific order for proper operation of the system. For an initial installation, these systems performed adequately. However, as with many industrial buildings, the security requirement and usage of various rooms and areas change thereby requiring the reassigning of different sensor loops. With the prior art systems, these changes may be very extensive and tedious and prone to numerous errors.

SUMMARY OF THE INVENTION

The object of this invention to provide an alarm control center in which the functional assignments of the input loops are readily interchangeable.

Another objection of the invention is to provide an alarm control center in which the alarm outputs are readily interchangeable.

A further object of the invention is to provide an alarm control center wherein the scanning frequency of a particular sensor loop is changed to verify an alarm condition in order to reduce false alarms.

A further object of the invention is to provide an alarm control center wherein the integrity of the system is maintained during power outages.

These objects are achieved in an alarm control center for interfacing an array of input sensor loops and an array of alarm outputs, comprising means for interchangeably preassigning alarm parameters for each of said input sensor loops, means for interchangeably preassigning alarm outputs for each of said input sensor loops, means for sequentially scanning said array of input sensor loops, means for conditioning the signals received from each of the scanned sensor loops, means for comparing the signals from each particular scanned input sensor loop with the respective preassigned alarm parameters, means for activating the appropriate alarm outputs when said comparing means indicates an alarm condition in the signal corresponding to the respective input sensor loop and means for periodically turning off and on selected circuits during power outages.

The invention concerns an alarm control center designed to accept signals from an input sensor array. These sensors are designed such that they measure variations in resistance, and provide information as to whether windows or doors are open, or if there is smoke or fire.

The input sensor array provides signals to an analog input system located in the alarm control center. The purpose of the analog input system is to provide necessary signal conditioning of the signals received from the external environment. The analog input system also provides protection circuitry so that the alarm control center may be safe from sabotage.

The processor portion of the alarm control center is a microprocessor-organized special purpose computer which receives the analog signal in the form an A/D input signal. This is the primary signal which is measured by the processor. If there are deviations from prescribed limits, the processor functions to provide alarms via the alarm output system and also to communicate changes to a higher level (such as central station) via its external communications controller.

The processor also has local control and display. Control is via a keyboard. This keyboard may be energized by an operator, or an installer, provided he has the proper key to use the system. When a user is present, and has the proper key inserted, the display on the alarm control center is activated and provides detailed information regarding system operation.

The alarm output system is a combined software and hardware configuration, which is programmable to allow a variety of different alarm schemes to be implemented under user control. The alarm output system is connected to an external alarm array which may include sirens, autodialers, local audio buzzers and display.

In addition to local control of the alarm control center, there is also a remote bus built into this system. The remote bus input/output system is capable of handling up 16 peripherals, which may include remote control unit, card reader and keyboard door control units, printers, etc.

The alarm control center has an external communications controller. The external communications controller is designed to provide an interface through the PTT network to a higher level system. In most cases the higher level system is an alarm central station.

DESCRIPTION OF THE DRAWINGS

With the above and additional objects and advantages in mind as will hereinafter appear, the invention will be described with reference to the accompanying drawings in which.

DESCRIPTION OF THE PREFERRED EMBODIMENT

Figure 1:
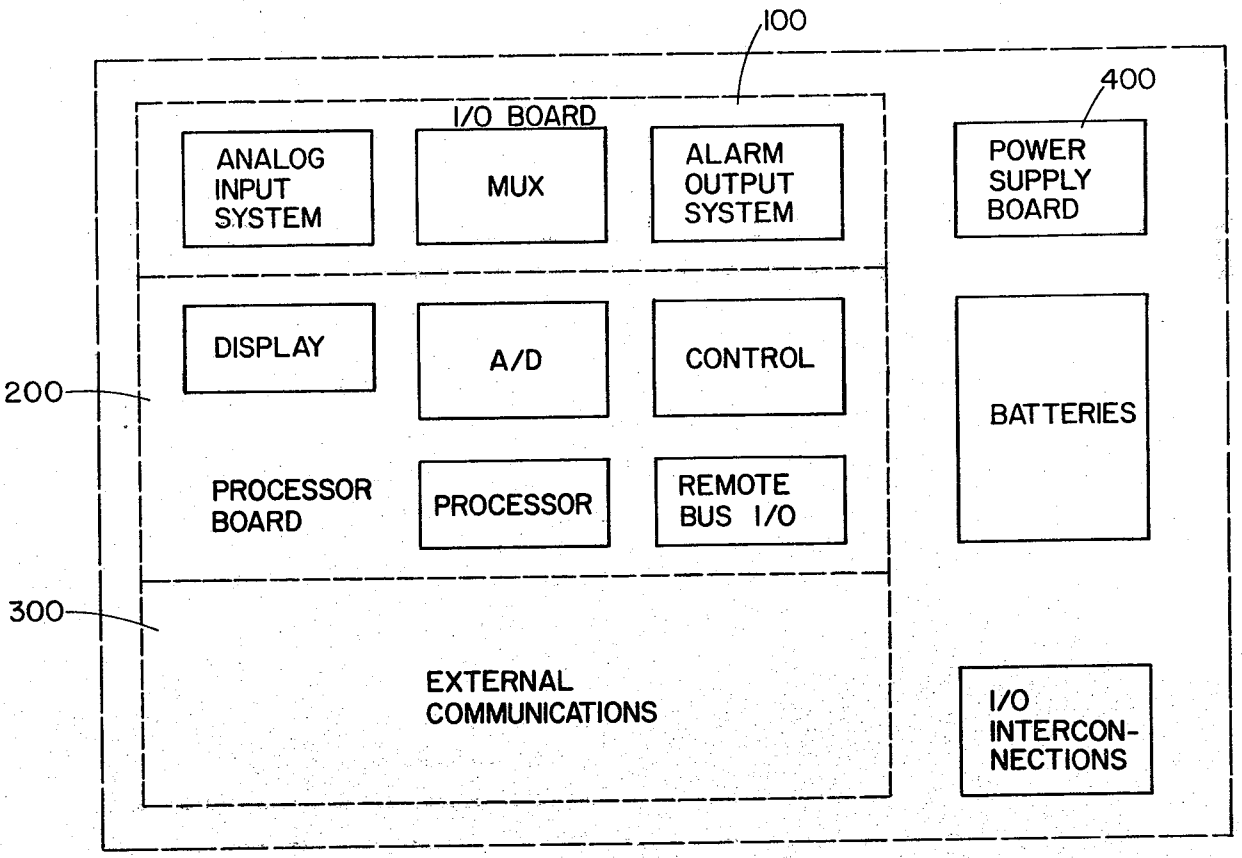
FIG. 1 is a block diagram of the main components of the alarm control center.

In FIG. 1 there is shown in block diagram form the major components of the alarm control center. These components include an input/output board 100, a processor board 200, an external communications board 300 and a power supply board 400.

The I/O board 100 represents the interfacing of the processor to the external world. The analog inputs and signal alarm outputs are mounted on this board. The analog inputs originate from external sensor loops which inputs are multiplexed under microprocessor control, the multiplex output signal being provided to the processor board 200 for further processing.

The processor board 200 contains the processor itself, control inputs via keyboard and operator/tamper switches, a digital display and indicator lights and an analog-to-digital converter.

The external communications board 300 provides interface to a telephone system. Contained on this board is an interface transformer with wire protection and the necessary hardware to automatically dial, through the telephone exchange, to a central alarm station. After the central station has been dialed, the communications board 300 contains the hardware to sense the connection and a modem to facilitate two-way data transmission. This communications board 300 also includes necessary circuitry for secure data transmission including block check character generation and detection means and encryption and decryption means.

The power supply board 400 provides an interface to the line voltage and a battery pack. The output of the power supply board 400 provides the necessary voltages and currents for operating the microprocessor system, the input sensor array, the alarm output, as well as some the peripheral devices. Means are contained on the power supply board 400 for detecting the loss of line voltage, failure of the battery pack, or failure of the power supply itself.

The Input/Output Board

Figure 2:
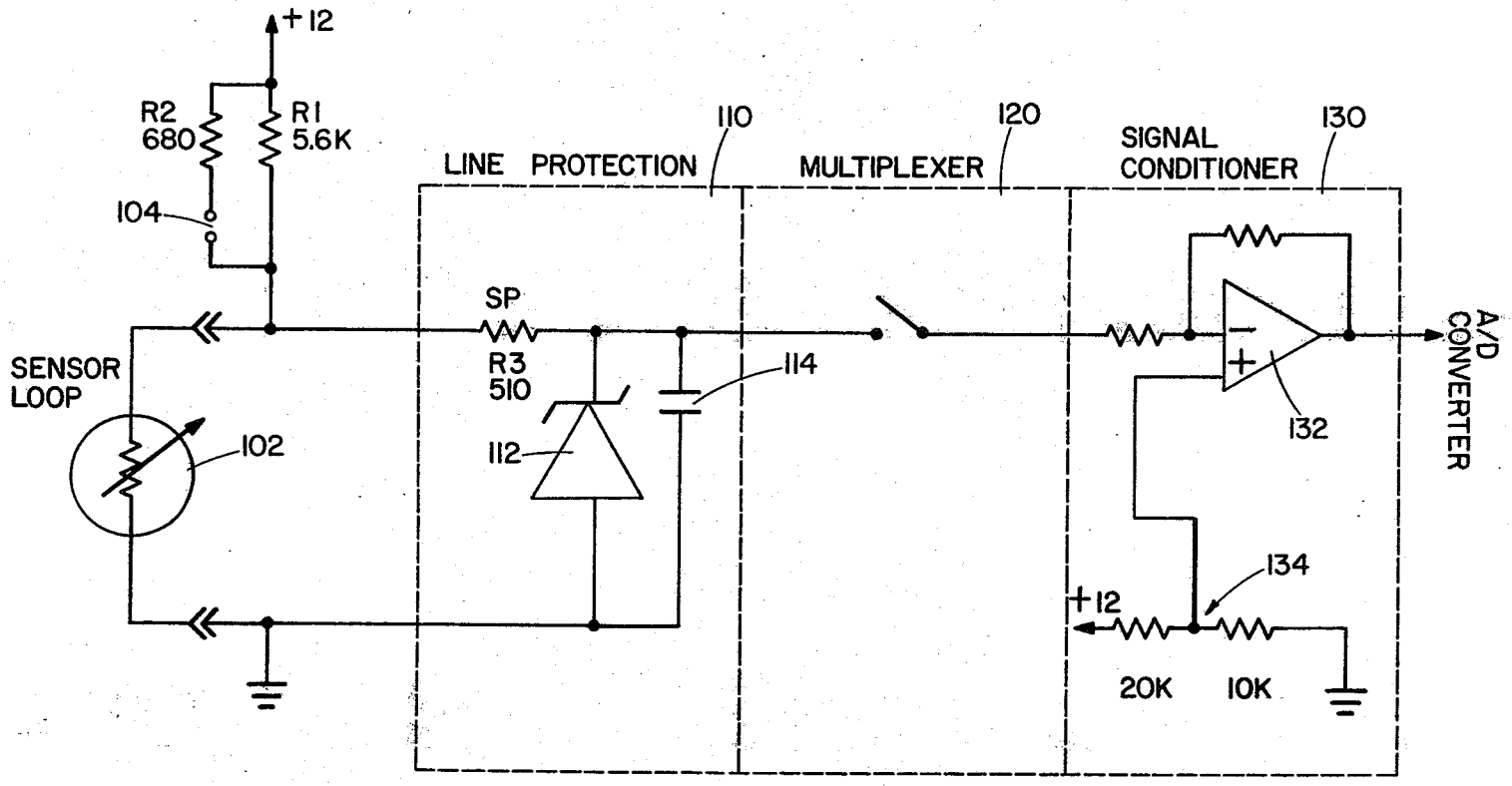
FIG. 2 shows a schematic of a typical sensor loop.

The input/output board 100 is capable of receiving the analog signals from thirty-two separate sensor loops. FIG. 2 shows a typical sensor loop and the relevant circuitry on the input/output board 100. The sensor is indicated by reference number 102 and may comprise up to ten individual 560-ohm sensors connected in series. 12 volt DC power is applied to one end of each sensor loop 102 from the power supply board 400 through respective resistors R1, which typically are 5.6 K-ohms, the other end of the each sensor loop 102 being connected to ground. With this configuration, assuming a balanced loop, 6 volts DC will appear at the junction of resistor R1 and the sensor loop 102.

Since, however, fire detection sensors are characteristically low impedance devices, resistor R2 is provided in parallel with resistor R1 to lower the overall effective resistance. Depending then on which loop the fire detection devices are situated, a jumper may be inserted across the terminals 104 thereby connecting R2 in parallel with R1. The input/output board 100 also has a resistor R3 connected to the junction of R1 and the sensor loop 102, which resistor R3 provides the analog signal from the sensor loop 102.

In order to protect the system from sabotage, each input sensor signal includes a line protection circuit 110 which comprises a diode 112 in parallel with a capacitor 114 which couples the loop signal from resistor R3 to ground. The diode 112 is selected to conduct at 15 volts. So arranged, the line protection circuit 110 provides protection from high voltage as well as RF signals being induced on the sensor leads.

The input loop signal is then passed to a 32-to-1 multiplexer 120, which is controlled via signals on a bus 122 from the processor board 200. In a typical arrangement, the multiplexer 120 may comprise four 8-to-1 multiplexers having the inputs coupled to the respective 32 sensor loops while the outputs therefrom are coupled to a 4-to-1 multiplexer. This configuration would allow for the exclusive scanning of predetermined groups of sensor inputs as well as the scanning of all the sensor inputs.

The outputs of the multiplexer 120 is then connected to a signal conditioner 130 which comprises an inverting amplifier 132 which also provides a level shift so that the input signal, which nominally is at 6 volts DC, is scaled down to 2 volts (inverted) for use on the processor board 200. This is accomplished by applying the output of the multiplexer 120 to the inverting input of the amplifier 132 while applying 4 volts DC, taken from a voltage divider 134, to the non-inverting input thereof.

The input/output board 100 also contains eight alarm relays 140 which may be arranged as normally opened or closed by the installer. These relays may be energized individually under the control of the processor and may be used to activate, for example alarms, lights, horns, sirens, or any other desired output.

The Processor Board

The processor board 200 is the basic control board in the alarm control center. This board 200 includes a microprocessor 205, ROM memories 210, RAM memories 215, an input keyboard 220, a four digit LED display 225 and an analog-to-digital converter 230. A suitable microprocessor which may be used in this system is the Intel 8039 which includes 128 words of RAM.

Figure 3:
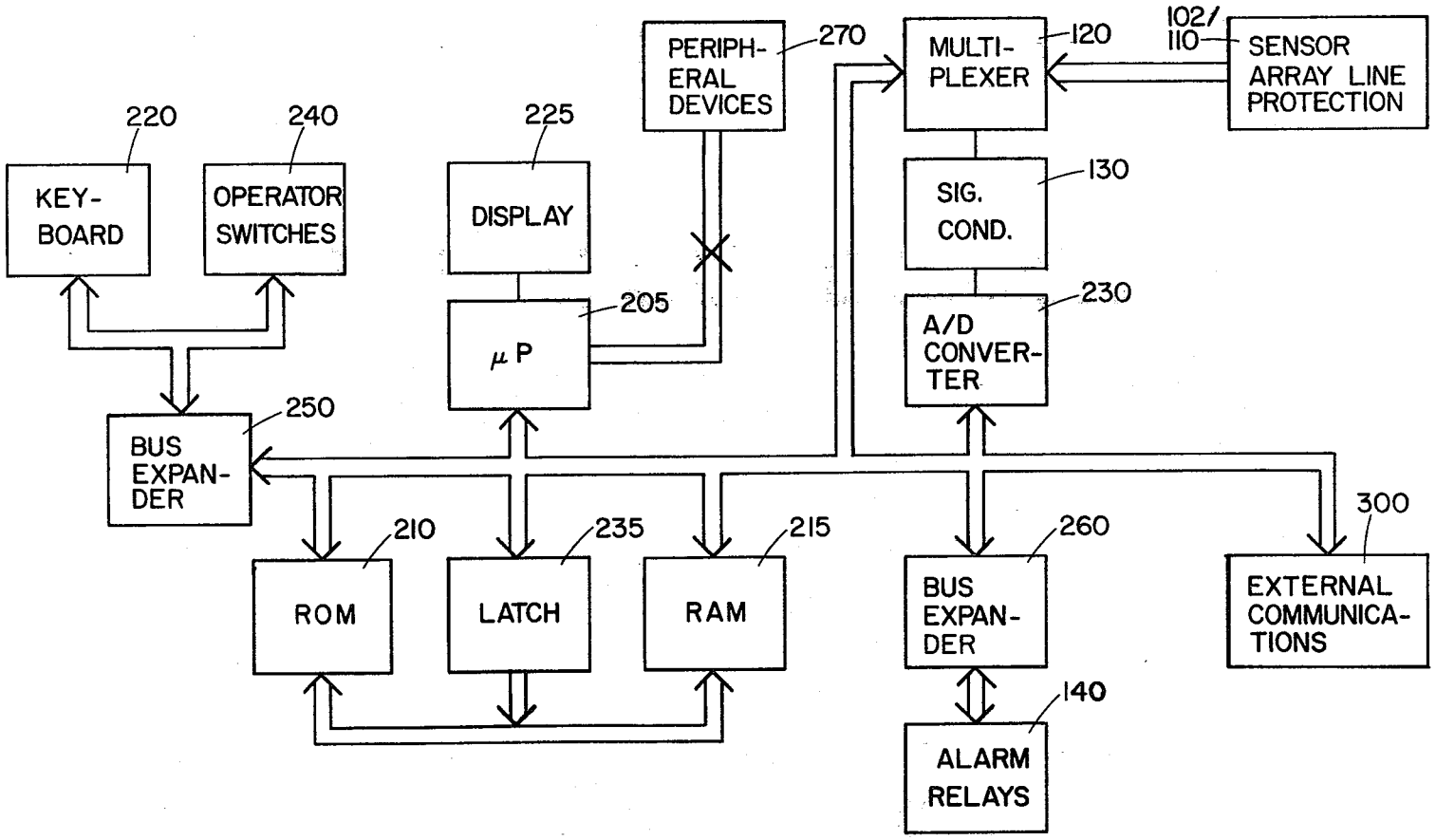
FIG. 3 is a block diagram of the alarm control center.

As shown in FIG. 3, the microprocessor 205 generates signals on an 8-bit bus to the external ROM memory 210 which contains the system program. Also accessed by the 8-bit bus is the external RAM memory 215 which has a total of $1024 \times 8$ bits of memory. Since this is a volatile memory, a battery is provided therefor in the event of the loss of line voltage and the battery back-up power system. A latch 235 is included for address latching by both the ROM 210 and RAM 215.

The analog input signals are passed through the A/D converter 230 which converts this signal to an 8-bit digital code which is transmitted to the microprocessor 205 by the 8-bit I/O bus.

In addition to the keyboard 220, the microprocessor 205 receives input digital data of various switch inputs 240 through a 16-bit I/O bus expander 250. The switch inputs include:

1. operator switch
2. calibration switch
3. tamper switch
4. installer switch
5. walk test switch
6. initialization switch
7. line voltage
8. battery
9. power supply A second 16-bit I/O bus expander 260 is used to provide the systems outputs. Signals from the microprocessor 205 carried over the 8-bit bus cause the bus expander 260 to activate the appropriate alarm relay 140.

The alarm control center has provisions for being remotely operated. When the protected premise is being secured for the night, for example, means are provided whereby the system may be activated at or near the exit door. To this end, peripheral devices 270 are coupled to the microprocessor 205 via a two-wire two-way bus.

There are nine different types of peripheral devices 270 which can be used with the alarm control center. These include a basic remote control unit (BRCU), display RCU (DRCU), DRCU with electric strike lock (ESL), security enable RCU (SRCU), SRCU with ESL, logging printer unit (LPU), interface control unit (ICU), door control unit (DCU) and security enable alarm control center.

Figure 4:
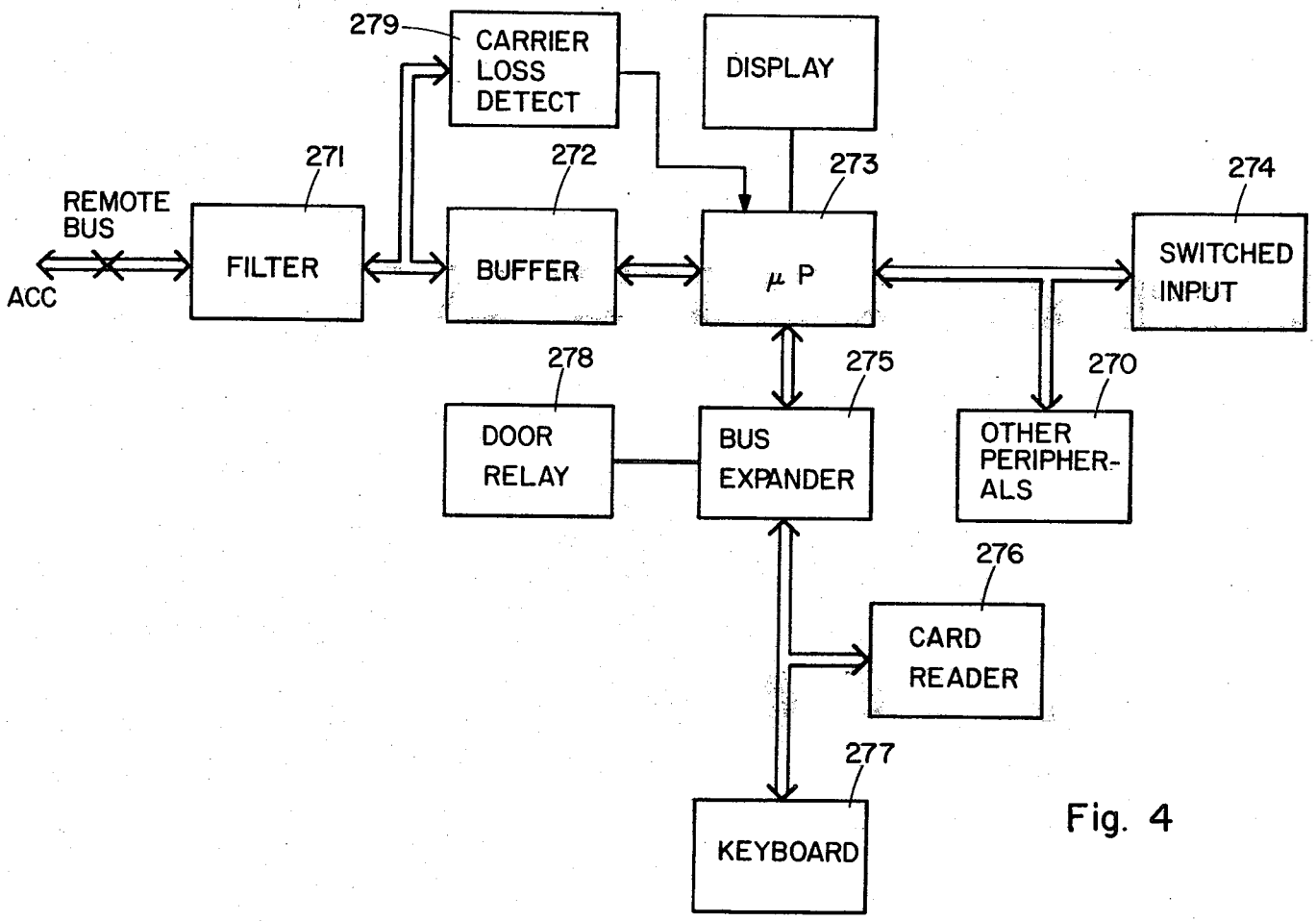
FIG. 4 shows a block diagram of a typical remote control unit.

The peripheral devices 270, while having different configurations, are, in general, set up similarly as shown in FIG. 4. The remote bus data-in signal is passed through filter 271, buffer 272 and then to a microprocessor 273, which may be the same as microprocessor 205. Other inputs to the microprocessor 273 are from switched inputs 274 which may include a door sensor, a key switch and a tamper switch. In addition, communication with other peripherals may be had along the same bus. Through a bus expander 275 the microprocessor 273 may interact with a card reader 276 and a keyboard 277, and may also activate a door relay 278. A carrier loss detection circuit 279 is also included and controls power to the peripheral device. This circuit 279, which may include a resistor/capacitor charging circuit coupled to a threshold detector arranged to trigger if the voltage across the charging circuit is not discharged by the remote bus input, is coupled to the output of the filter 271 and has an output coupled to the microprocessor 273.

External Communications Board

The external communications board 300 provides the interface of the alarm control center to the transmission system. This board performs the following functions:

1. Accept messages for transmission from the alarm control center to a higher level device;
2. Provide pulse or touch-tone dial capability for switched network applications;
3. Offer encryption/decryption facilities for messages requiring the same;
4. Compute block character check sums for each message transmitted;
5. Provide modem serial data transmission capacity;
6. Provide receiver tone and ring detection;
7. Provide voice transmission capability for eavesdropping;
8. Receive messages and provide error checking capabilities;
9. Automatic retransmission of messages having communication errors; and
10. Pass valid messages to the alarm control center.

Figure 5:
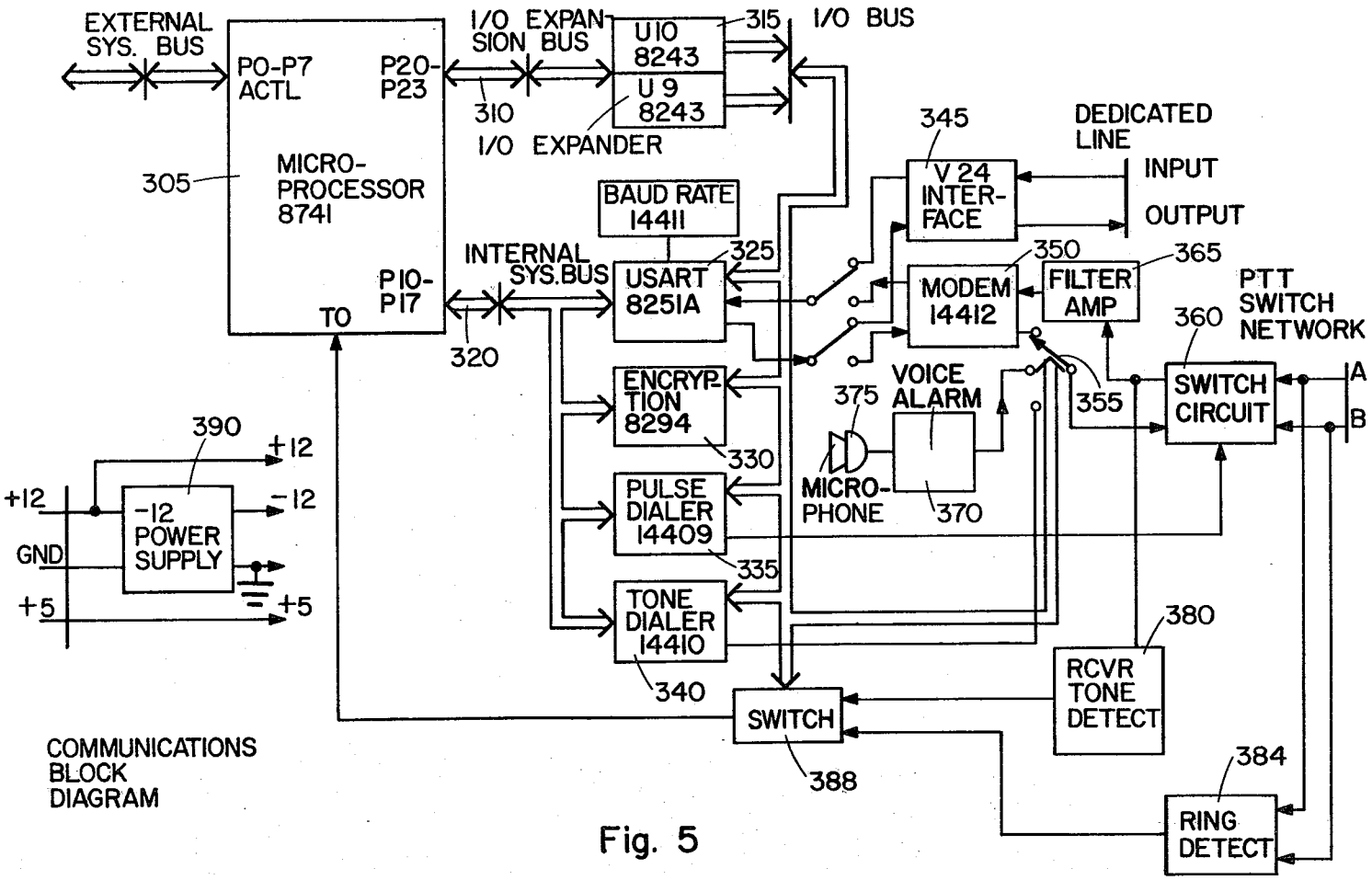
FIG. 5 shows in block diagram form the external communications board.

FIG. 5 is a functional block diagram of the modules in the communication board 300, all of which are either commercially available items or have obvious constructions.

A microprocessor 305 is coupled to the bus from the processor board 200. The microprocessor 305 may be type number 8741. The microprocessor 305 has a first bus 310 coupled to a dual bus expander 315. The output from the bus expander 315 is coupled, along with a second bus 320 from the microprocessor 305, to a USART 325 type 8251A, an encryption/decryption module 330 type 8294, a pulse dialer 335 type 14409 and a tone dialer 340 type 14410. The input/output to/from the USART 325 may be applied selectively to a V24 interface 345 to dedicated lines or to a modem 350 type 14412. The output of the modem 350 is applied to the telephone lines through a relay 355, controlled by the microprocessor 305, and a switching circuit 360, controlled by the pulse dialer 335. Return data is processed through the switching circuit 360 and a filter amplifier 365.

The relay 355 also selectively couples the switching circuit 360 with a voice alarm 370, having an eavesdropping microphone 375 coupled thereto, and the tone dialer 340. To access the telephone lines, the communications board 300 also includes a receiver tone detection circuit 380 and a ring detection circuit 384 both coupled to the microprocessor 305 through a switch 388 controlled via the bus expander 315.

Since some of the modules used on the external communications board 300 require −12 volts DC, a power supply 390 is included thereon and is energized by the main power supply 400.

In another embodiment of the invention, the microprocessor 305 may be a type number 8035 and communicates with the microprocessor 205 via the peripheral devices 270 remote bus.

Power Supply Board

Figure 6:
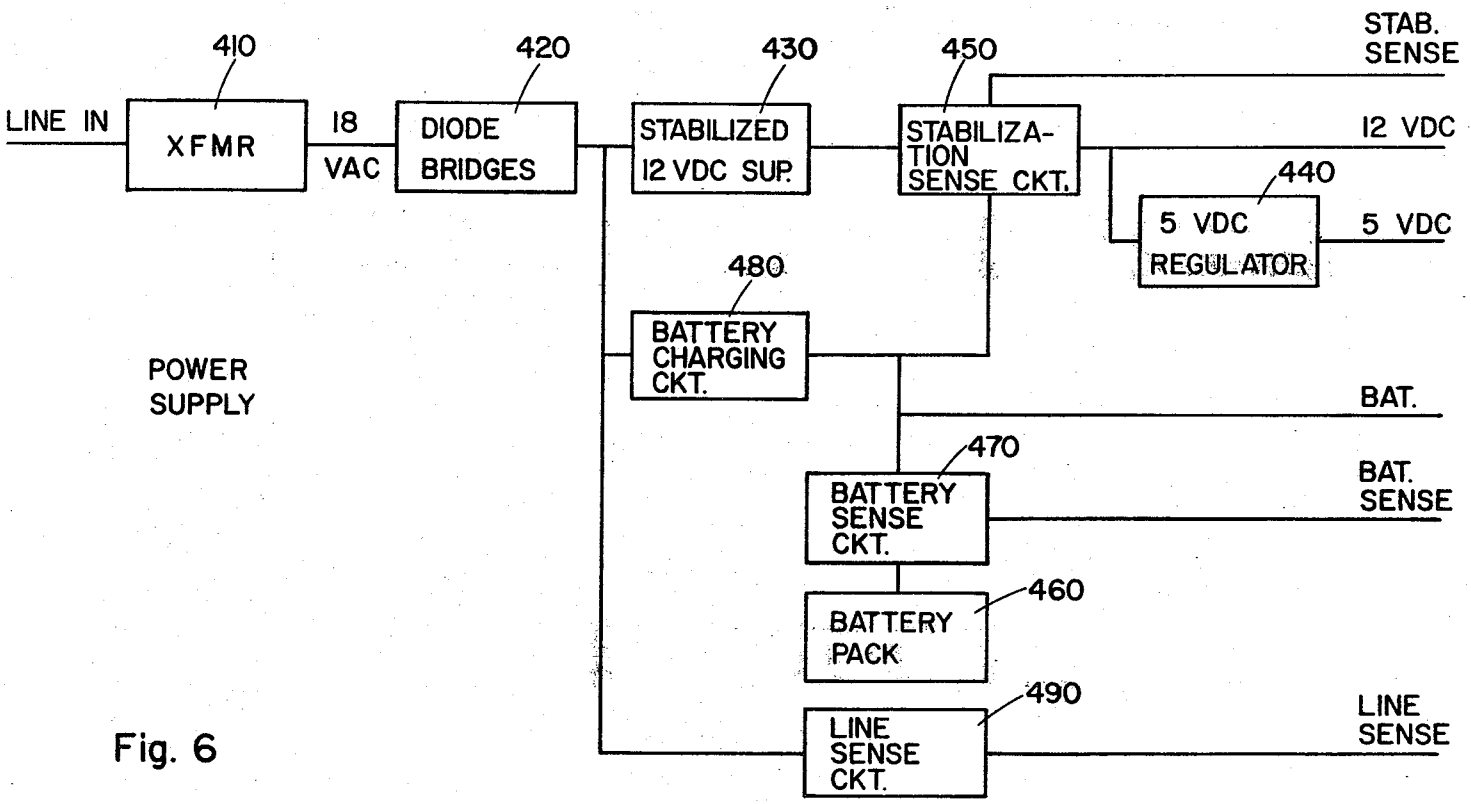
FIG. 6 shows in block diagram form the power supply board of the invention.

FIG. 6 shows a block diagram of the power supply board 400. The power supply board 400 includes a transformer 410 which steps down the input line voltage to 18 volts AC. The transformer 410 includes several input taps so that it is adaptable to several line voltages. The 18 volt AC output from the transformer 410 is applied to a pair of diode bridges 420 for rectification. A stabilized 12 volt DC supply 430 is coupled to the output of the diode bridges 420 and provides the 12 volt DC used throughout the alarm control system. A 5 volt DC regulator 440 is coupled to the 12 volt DC output to provide an output of 5 volts DC also used in the system. A stabilization sensing circuit 450 is included in the power supply board 400 which provides an output signal to the microprocessor 205 when there is a failure in the stabilized 12 volt DC supply 430.

In the event of failure of the input line voltage, the power supply board 400 includes a battery pack 460 as a back-up power source. Coupled to the battery pack 460 is a sensing circuit 470 which checks the condition of the battery pack 460 and provides an output signal on failure of the battery pack 460. A battery charging circuit 480 is coupled to the output of the diode bridges 420 and maintains the battery pack 460 at full charge.

When there is a loss of stabilization, the stabilization sensing circuit 450, in addition to its signalling output, disconnects the 12 volt DC supply from the output, disconnects the charging circuit 480 from the battery pack 460, and couples the battery pack 460 to the 12 volt DC output.

Notwithstanding the above, if the battery pack 460 output voltage falls below a certain level, the sensing circuit 470, in addition to its signal to the microprocessor 205, disconnects the battery pack 460 to prevent damage thereto due to extreme discharge.

There is also included on the power supply board 400, a line voltage sensing circuit 490 coupled to the output of the diode bridges 420 which signals the microprocessor 205 on failure of the line voltage.

Software

Figure 7:
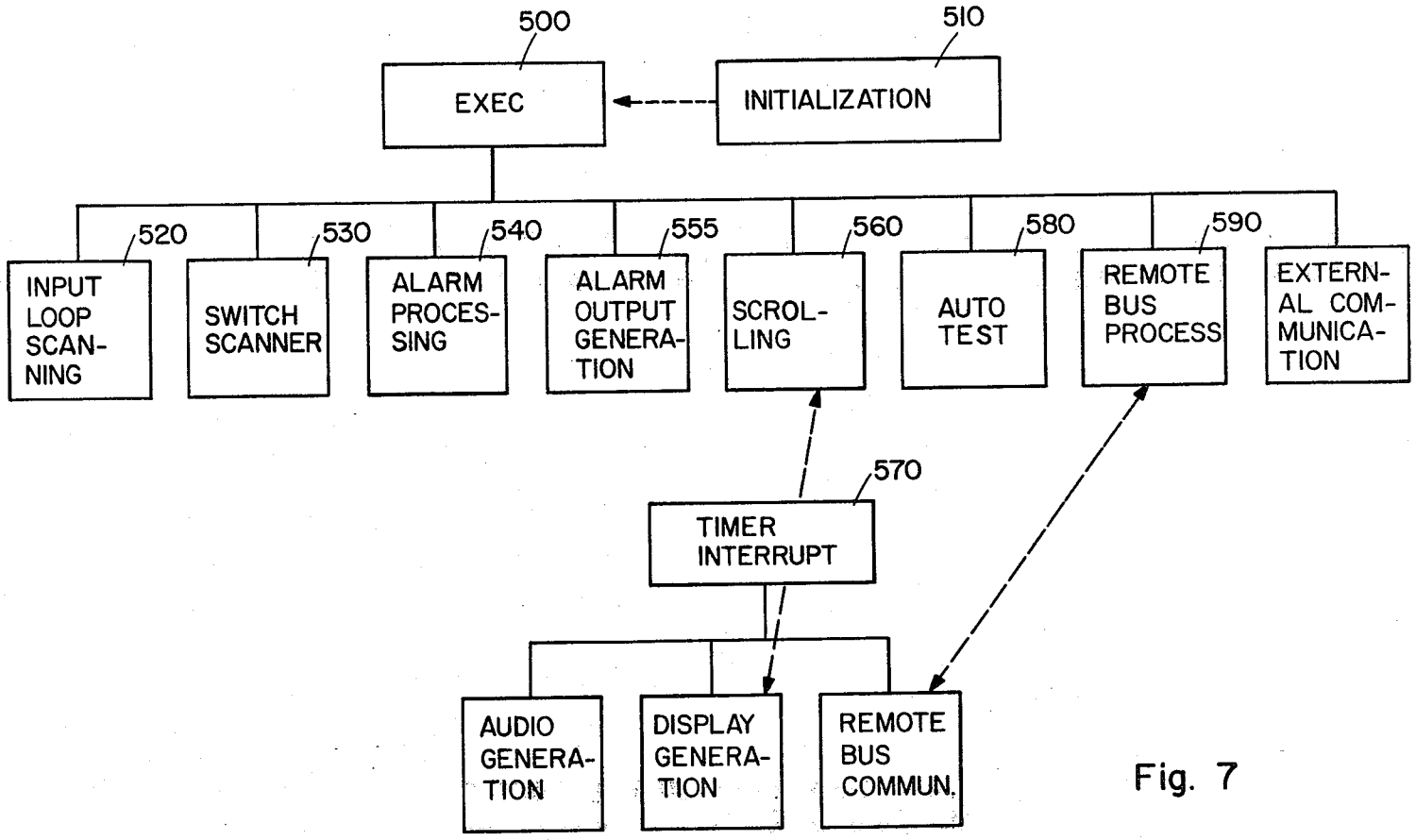
FIG. 7 provides in block diagram form, the organization of the software used to control the alarm control center.

FIG. 7 provides in block diagram the organization of the software used to control the alarm control center. The EXEC module 500 provides the communication and control of the entire software system.

The system is first established regarding mode, parameter assignment and loop assignment via an initialization routine 510. This routine is hardware programmable so that when there is a loss of power followed by a power restoration or when a reset switch has been pressed, the system will go to the selected program initialization.

Following initialization, the EXEC calls the various other routines as required, which will now be described.

A loop scanning routine 520 handles all the input loops and decides the acceptable tolerance from an initial reference value based on the type of loop being examined. At initialization, the loop scanning routine 520 determines the existing voltage at the loop and if it is within an acceptable tolerance, it takes this initial value as the reference voltage for that loop for all later determinations of conditions.

In the scanning of a loop, if a change in status is detected, the program presets a change counter and stores the new condition. When, in subsequent scans, there is no change in status, the counter is advanced and compared with a maximum. Since the scanning of a particular loop is repeated approximately every 30 milliseconds, the counter is allowed to go to 5, representing 150 ms during which the input has been in the new condition. The loop scanner routine 520 then enters into a high speed mode dedicating its scanning to the particular loop for 32 cycles. If during this period at least 70% of the time the input is in the new condition, then this status is processed as a valid input change. If no previous alarm exists for the loop, preparations are made to call the alarm processor routine 540.

The switch scanner routine 530 monitors the operation of the front panel keyboard, the installer and operator key switches, the alarm control center door tamper switch, the installer initialization and walk test switches, as well as the status of the line voltage, battery and power supply.

The switch scanner routine 530 will call the alarm processor routine 540 under the following conditions:

1. tamper switch detected when both the operator and installer switches are not set;
2. loss of line voltage;
3. failure of stand-by battery; and
4. failure of the power supply only if the line voltage is present.

If in the case of failure of the stand-by battery there is also failure of either the line voltage or the power supply, the switch scanner routine 530 puts the alarm control center program into a "wait" state, stopping all further scanning and processing and returning to the EXEC routine 500. The system may only be taken out of this "wait" condition by a hardware reset by the installer.

The alarm processing routine 540 receives the alarm calls triggered by failures in the input loops, peripherals, tamper switches and hardware. For each alarm cell, there are four possible modes of operation, namely night mode guarded and unguarded, and day mode guarded and unguarded. The alarm processing routine 540 first determines the particular mode of operation and then retrieves a preprogrammed table of alarm indications for the particular alarm call and mode of operation. The alarm indications are as follows:

1. ACC buzzer on
2. External alarm on
3. Power failure LED on
4. ACC alarm on
5. Deterrent siren and outdoor light on
6. I/O linkage
7. External autodial on
8. Spare The alarm processing routine 540 then sets the bits for each specific output and then calls the alarm output generation routine 555.

The alarm output generation routine 555 performs the task of actuating (or deactuating) the various alarm relays based upon bit words set by the alarm processing routine 540.

The scrolling routine 560 provides for the programming of the alarm control center by controlling the digital data being displayed and by storing the new information entered by an operator or an installer. This scrolling routine 560 is used in conjunction with the switch scanner routine 530 and depending upon whether the operator or the installer switch is set, establishes those functions which may be performed.

In particular, an installer is able to change system parameters such as assignment of loops, output circuits and peripheral types. For each loop the installer can assign specific output linkages for output circuits particularly relay positions for alarm conditions, while for peripherals, various security levels. An installer may also adjust all the various timing delays, for example entrance and exit delays, siren output and pause duration, and the operation of a real time clock.

An operator, however, may only inhibit and reenable the loops, outputs, peripherals and the real time clock, and assign and cancel security card and cipher codes.

The time interrupt routine 570 operates under control of an internal 1 millisecond clock and is used to control, among others, the generation of audio signals at the alarm control center, such as the buzzer. The timer interrupt routine 570 is coupled to the scrolling routine 560 in that it outputs and refreshes the appropriate display digit, in a time multiplex fashion, or LED bit. The timer interrupt routine 570 is also coupled to the remote bus processing routine 590 in that it controls the actual transmitting and receiving of data over the remote bus.

The auto test routine 580 is performed whenever a mode switching is requested or under the control of an operator or installer. During the routine, each sensor loop is forced into the high state for two scanning cycles, then the low state for two scanning cycles, and then allowed to assume its normal state. If any inconsistency occurs in the above testing or if a failure occurs in the battery, power supply, tamper switches or peripherals, switching from day mode to night mode is inhibited, or an appropriate error message is displayed.

The remote bus processing routine 590 forms the communication with the peripheral devices. The routine first checks whether there is an error in the received message. If so the routine discards the error message and communicates again with the peripheral device. Keeping track of the number of errors for the specific peripheral device, the remote bus processing routine 590 initiates an alarm call if a maximum is exceeded. Assuming the message is error free, the remote bus processing routine 590 updates the file for the particular peripheral device and appropriate processing procedures are initiated which include switching the system mode, indicating an alarm, or allowing a door to be opened.

In the event of the loss of line voltage or power supply failure, the remote bus processing routine 590 periodically stops and restarts remote bus communications. Each peripheral device 270 connected to the remote bus will then, through the use of the carrier loss detection circuit 279 contained therein, switch itself off thereby conserving battery power until the remote bus communications is restarted.

Figure 8:
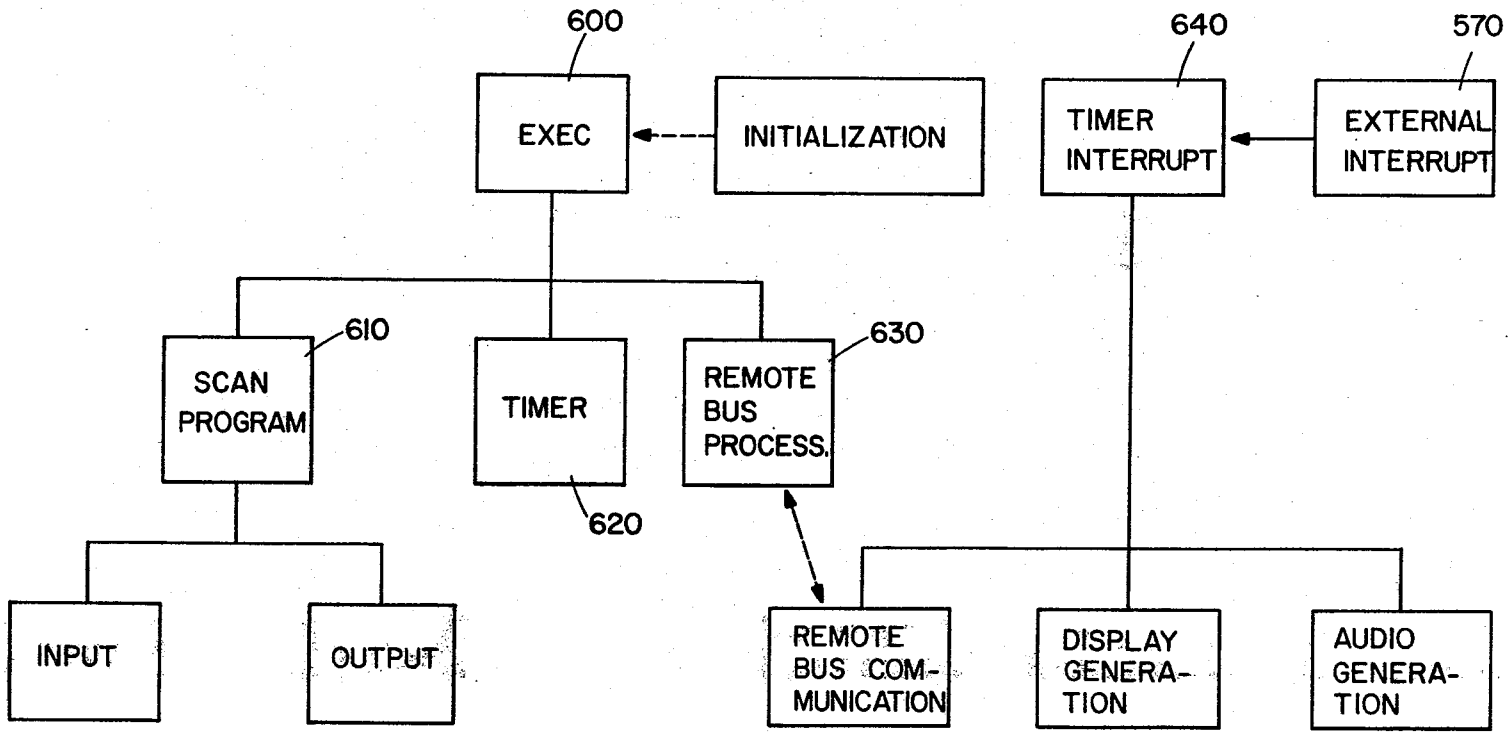
FIG. 8 provides in block diagram form the organization of the software used to control a typical remote control unit.

FIG. 8 provides in block diagram the organization of the software used for the peripheral devices. The system operation is controlled by an EXEC 600 program. This EXEC 600 has, in peripheral operation, a more limited role. Typically, a peripheral device may be a remote control unit designed to switch the system from day to night modes and back. Such a device would operate when a user inserted his key into the unit and turned it. The turning of the key would initiate a sequence which would provide, if the user leaves the premises at night, a visual display of those loops which would prevent proper operation, or loops which were previously inhibited by the user, or else a signal that the system was okay.

As modes are switched from day to night, this is signalled by LED's on the peripheral itself. The peripheral also generates an audio tone indicating that the user started the timing of his exit delay. As the user opens doors to leave the premise, the audio tone changes in pitch so that the user knows that the system is functioning properly.

Incorporating these functions in a peripheral device, is handled by three routines called the scanning routine 610, the timer routine 620, and the remote bus processing routine 630.

A peripheral device is different from the alarm control center in that the scanning routine 610 scans both the input and the output, the only difference being the direction of scan. There is some limited processing of inputs in the peripheral devices, however major analysis of input signals from a peripheral device is performed by the alarm control center.

The timer program 620 in the peripheral has significance in that events are synchronized to system operation. There is a similar timing capability in the alarm control center, however it is incorporated as part of the scrolling routine 560, which is time synchronized to the external world.

As in the alarm control center, the peripheral device also contains a timer interrupt section 640. The timer interrupt 640 performs a similar function of audio generation, display generation and remote bus communication. It is the mirror image of the timer interrupt routine 570 in the alarm control center except for one major difference. The timer interrupt routine 640 in the peripheral device must be synchronized to the timer interrupt routine 570 of the alarm control center. This is necessary to ensure proper data communication between the alarm control center and the peripheral device. Therefore, to ensure proper synchronization, the peripheral device utilizes the external interrupt to provide synchronization between the two units, to within a few microseconds. This allows extremely reliable data communication on the remote bus.

System Operation

The alarm control center is designed such that there are two levels of user interface, namely operator interface and installer interface. The normal operator interface to the system is on entering and exiting the premises. When an owner of a store, which is protected by the alarm control center system, enters his premises, he initiates a procedure which switches his system from the night mode (full protection) to the day mode (reduced protection). This interface is handled through a remote control unit connected to the alarm control center. An alarm control center can handle up to 16 peripheral devices consisting of 9 different types. Each peripheral device has an individual address and a unique communication capability. Selection of the peripheral device required an incorporation of it into the system which is the job of the skilled installer. As far as an operator is concerned, his interface has the primary function of day/night and night/day switching, and status display. In certain situations, more sophisticated capabilities are provided such as card and cipher access control of selective areas, incorporation of electric strike locks and door strikes and using volume printers for remote camera control.

The operator switches the system by inserting his key into a remote device and turning his key. This initiates a sequence of events beginning with a test of the system status which ultimately leads to a display of the system condition at the time of key insertion, and, switching operating modes.

Similarly, when the operator leaves his premise at night he repeats the operation. He inserts his key into his remote control device, and if the display is proper, he leaves his premises. The system switches from "reduced protection" to "full protection" if all operational parameters are in accordance with predefined specifications.

In the event that there has been an alarm in the system, the operator is able to get preliminary information from his remote device, provided the particular device has the necessary display means. In any event, the operator can get full information by going to the alarm control center itself, inserting his operator key into the alarm control center and turning it. The system will display information which allows the operator to ascertain the nature of the problem.

The next level of user interface is the installer. In this case we have a higher level user. The installer requires more information from the system and also has more control over the alarm control center program. The installer normally sees the system at two different times. The first time is on initial installation. When the installer initially connects a system, he must perform individual installation of all the sensors necessary to protect the premises. He then proceeds to connect the wires to the alarm control center. Connection is done by an interconnection scheme which allows very rapid connection of individual wires into cable harnesses with connectors. The connectors allow rapid plug-in of loops to the I/O board 100 inside the alarm control center. The installer at installation must connect the line voltage and battery to provide proper system operation. After a system has been wired in, it is necessary to check and align it. Checking alignment is automatically accomplished by the microprocessor contained in the alarm control center when the appropriate controls are pressed by the installer. In addition to checking and aligning the input loops, the alarm control center also forces the installer to step through all of the devices which he has the possibility of programming. This is done so that the installer knows what parameters are entered into the system and the alarm control center has the proper information to initiate its surveilence of the premises.

The second time the installer sees the system is when the user has a problem. In this case, the installer's information is similar to the user's information, namely the source of the problem. The major function which the installer uses is an automatic repeat viewing "walk test" of the individual loop creating problems.

Interfacing to the external environment is via two different types of interfaces. The first interface is the interface of peripheral devices connected to the alarm control center. This interface, the remote bus, is designed to work at aggregate distances of up to 500 meters. From 1 to 16 peripheral devices may be connected on the remote bus. Communication to peripheral devices utilizes synchronization to hardware interrupts between the alarm control center and the peripheral devices. Then communication begins with two modes of operation, namely individual peripheral addressing and group addressing. The two communication modes are intermixed so that fast response may be obtained to changes in individual peripheral status yet each peripheral may have its time for communication to establish full operational capability.

Communication to the external world is handled by a separate communications printed circuit board 300 which is mounted in the alarm control center. There is a possibility of using hierarchical communications modules. In the end it is designed that the alarm control center is able to be monitored, programmed, and controlled by a central alarm station.

A different type of communication was necessary for the PTT interface as contrasted with the remote bus communications. This is because external communications requires a higher level of security since it is more vulnerable to attempts to damage the communications system. External communications uses parity bits, block checking characters and echo back procedures to minimize the effect of noise and extraneous signals introduced into the communication line. Moreover, the alarm control center communications board 300 has the capability of providing encryption of the data to reduce the possibility of sabotage.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

We claim:

1. An alarm control center for interfacing with an array of input sensor loops, each of said loops having a plurality of sensors each arranged to vary in resistance indicating whether, for example, windows and doors are open, or the presence of smoke or fire, and an array of alarm outputs including, for example, sirens, automatic telephone dialers, local audio buzzers and displays, said alarm control center comprising:

means for interchangeably preassigning alarm parameters for each of said input sensor loops;

means for interchangeably preassigning alarm outputs for each of said input sensor loops;

means for sequentially scanning said array of input sensor loops;

means for conditioning the signals received from each of the scanned sensor loops;

means for comparing the signal from each particular scanned input sensor loop with the respective preassigned alarm parameters; and means for activating the appropriate alarm outputs when said comparing means indicates an alarm condition in the signal corresponding to the respective input sensor loop.

2. An alarm control center as claimed in claim 1 which further comprises means for facilitating the remote controlling of said alarm control center whereby said scanning means, said comparing means and said alarm activation means may be remotedly controlled.

3. An alarm control center as claimed in claim 1 which further comprises means for selectively effecting a day mode of operation, wherein certain of said input sensor loops and alarm outputs are inhibited, and a night mode of operation, wherein all of said sensor loops and alarm outputs are operational, and means for automatically preventing the switching from one mode to the other when alarm conditions exist.

4. An alarm control center as claimed in claims 1 or 2 which further comprises remote means for operating said alarm control center including remote activation/-deactivation units.

5. An alarm control center as claimed in claim 1, wherein the scanning rate of a particular sensor loop by said scanning means may be selectively increased to verify the occurrence of an alarm condition in said sensor loop.

6. An alarm control center as claimed in claim 4, which further comprises battery means for powering said alarm control center in the event of power outages.

7. An alarm control center as claimed in claim 6, which further comprises means for switching on and off said remote operating means to extend battery operation time.

8. An alarm control center as claimed in claim 6, which further comprises means for sensing the condition of said battery means and for suspending the operation of said alarm control center to prevent excessive discharge of said battery means.

* * * * *